US010566730B2

(12) United States Patent
Zhang et al.

(10) Patent No.: US 10,566,730 B2
(45) Date of Patent: Feb. 18, 2020

(54) ELECTRICAL CONNECTOR AND ELECTRICAL CONNECTOR ASSEMBLY THEREOF

(71) Applicant: FOXCONN INTERCONNECT TECHNOLOGY LIMITED, Grand Cayman (KY)

(72) Inventors: Teng-Fei Zhang, Kunshan (CN); Wei Zhong, Kunshan (CN); Jian-Kuang Zhu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 10 days.

(21) Appl. No.: 15/944,793

(22) Filed: Apr. 4, 2018

(65) Prior Publication Data

US 2018/0294596 A1 Oct. 11, 2018

(30) Foreign Application Priority Data

Apr. 5, 2017 (CN) ..... 2017 1 0216684

(51) Int. Cl.

| | |
|---|---|
| ***H01R 13/506*** | (2006.01) |
| ***H01R 13/24*** | (2006.01) |
| ***H01R 13/52*** | (2006.01) |
| ***H01R 13/642*** | (2006.01) |
| *H01R 13/62* | (2006.01) |

(52) U.S. Cl.

CPC ..... *H01R 13/506* (2013.01); *H01R 13/2471* (2013.01); *H01R 13/521* (2013.01); *H01R 13/642* (2013.01); *H01R 13/6205* (2013.01)

(58) Field of Classification Search

CPC .. H01R 13/506; H01R 13/24; H01R 13/2471; H01R 13/642

See application file for complete search history.

(56) References Cited

U.S. PATENT DOCUMENTS

| | | | | |
|---|---|---|---|---|
| 7,329,151 | B2 * | 2/2008 | Wu | H01R 13/5808 439/456 |
| 7,625,212 | B2 * | 12/2009 | Du | H01R 13/6205 439/39 |
| 9,190,771 | B2 * | 11/2015 | Qian | H01R 13/6205 |
| 9,281,626 | B2 * | 3/2016 | Lin | H01R 13/6581 |

(Continued)

FOREIGN PATENT DOCUMENTS

| | | |
|---|---|---|
| CN | 203895683 U | 10/2014 |
| CN | 204144519 U | 2/2015 |
| CN | 204720597 U | 10/2015 |

*Primary Examiner* — Briggitte R. Hammond

(74) *Attorney, Agent, or Firm* — Wei Te Chung; Ming Chieh Chang

(57) ABSTRACT

An electrical connector mounted to a magnetic mechanism includes an insulative housing and a number of terminals retained in the insulative housing. The insulative housing includes a base and a mating portion extending forwardly from the base. The mating portion includes an upper wall, a lower wall opposite to the upper wall, two side walls connecting between the upper and lower walls, and a mating space defined therebetween. Each of the terminals includes a connecting section extending into the mating space. The electrical connector also includes a pair of pogo pins respectively retained in the two opposite sides of the mating portion. The pogo pins and the mating portion are spaced apart from each other.

20 Claims, 7 Drawing Sheets

(56) References Cited

U.S. PATENT DOCUMENTS

| | | | | |
|---|---|---|---|---|
| 9,673,556 | B2 * | 6/2017 | Kao | H01R 13/502 |
| 9,755,370 | B2 * | 9/2017 | Little | H01R 13/6581 |
| 9,780,468 | B2 * | 10/2017 | Yokoyama | H01R 12/7047 |
| 9,853,393 | B2 * | 12/2017 | Guo | H01R 13/405 |
| 2008/0305658 | A1 * | 12/2008 | Ko | H01R 13/5808<br>439/76.1 |
| 2016/0020537 | A1 * | 1/2016 | Ju | H01R 24/78<br>439/83 |

* cited by examiner

ELECTRICAL CONNECTOR AND ELECTRICAL CONNECTOR ASSEMBLY THEREOF

BACKGROUND OF THE INVENTION

1. Field of the Invention

The present invention relates to an electrical connector and an electrical connector assembly thereof.

2. Description of Related Arts

China Patent No. 204720597 discloses an electrical connector including an insulative housing, a first contact module, a second contact module, a shielding plate, an upper base, a lower base, a metallic member, and a shielding shell. The insulative housing includes an upper wall, a lower wall, two side walls connecting between the upper and lower walls, and a receiving space defined therebetween. The shielding plate includes two elastic portions extending forwardly from two opposite sides thereof to provide an insertion force between the electrical connector and a corresponding connector. However, the elastic portions would be easily deformed so that the stability of the connection between the electrical connector and the corresponding connector is poor.

Therefore, it is desired to provide a new electrical connector.

SUMMARY OF THE INVENTION

An electrical connector mounted to a magnetic mechanism comprises an insulative housing and a plurality of terminals retained in the insulative housing. The insulative housing comprises a base and a mating portion extending forwardly from the base. The mating portion comprises an upper wall, a lower wall opposite to the upper wall, two side walls connecting between the upper and lower walls, and a mating space defined therebetween. Each of the terminals comprises a connecting section extending into the mating space. The electrical connector also comprises a pair of pogo pins respectively retained in the two opposite sides of the mating portion. The pogo pins and the mating portion are spaced apart from each other.

DETAILED DESCRIPTION OF THE PREFERRED EMBODIMENTS

Referring to FIGS. 1-7, an electrical connector assembly comprises a magnetic mechanism (not shown) and an electrical connector 100 mounted to the magnetic mechanism.

The magnetic mechanism includes a first magnetic member (not shown). The first magnetic member would be a magnet or a metallic member. The electrical connector 100 is used to connect with a corresponding connector (not shown) with a second magnetic member (not shown). The first and second magnetic members could magnetically attract to each other.

Figure 1:
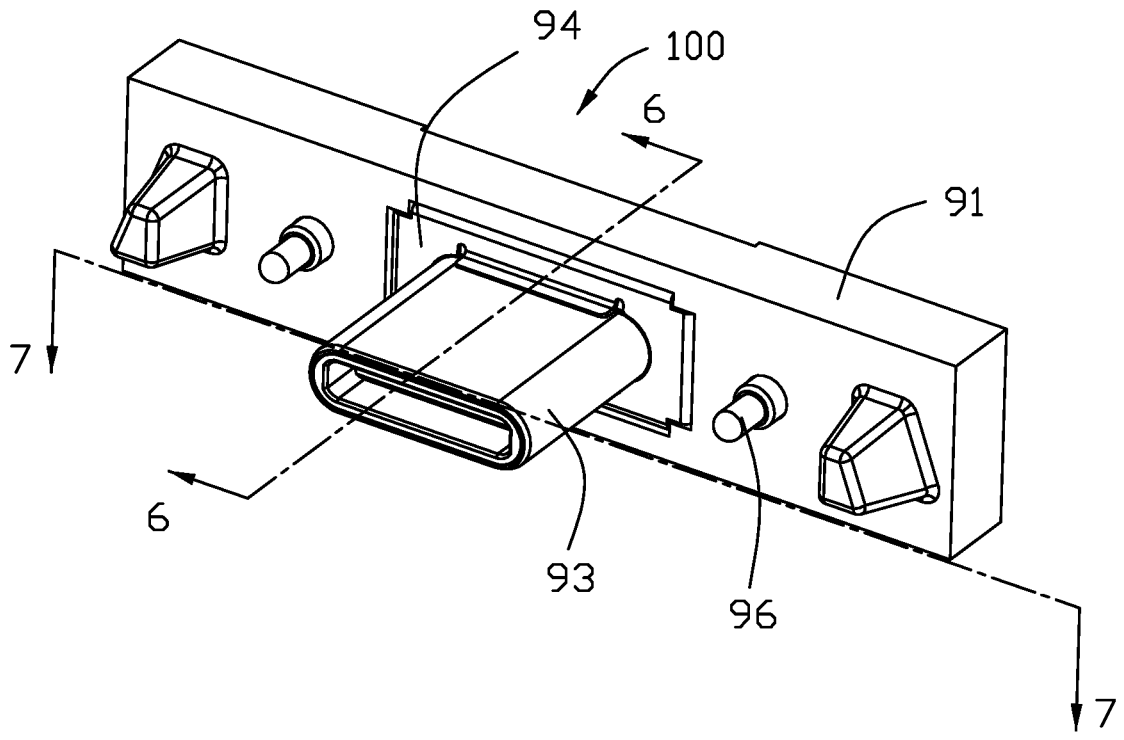
FIG. 1 is a front perspective view of an electrical connector in accordance with the present invention.
Figure 2:
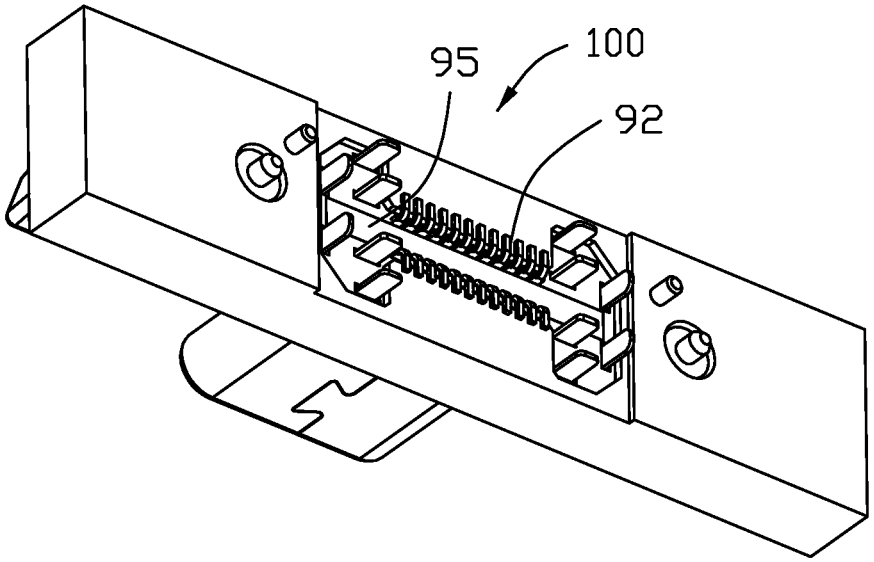
FIG. 2 is a rear perspective view of the electrical connector.
Figure 3:
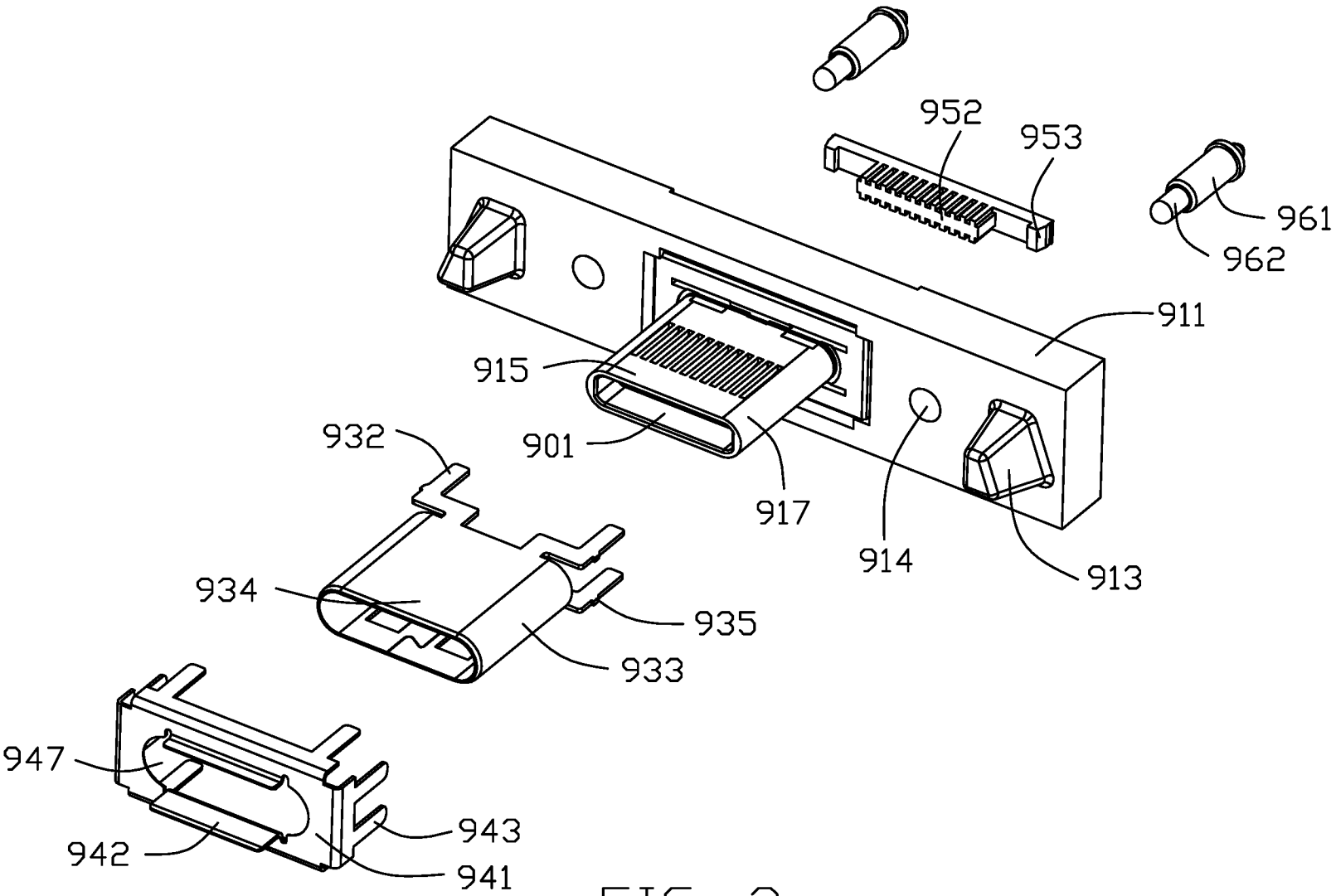
FIG. 3 is a front exploded view of FIG. 1.
Figure 4:
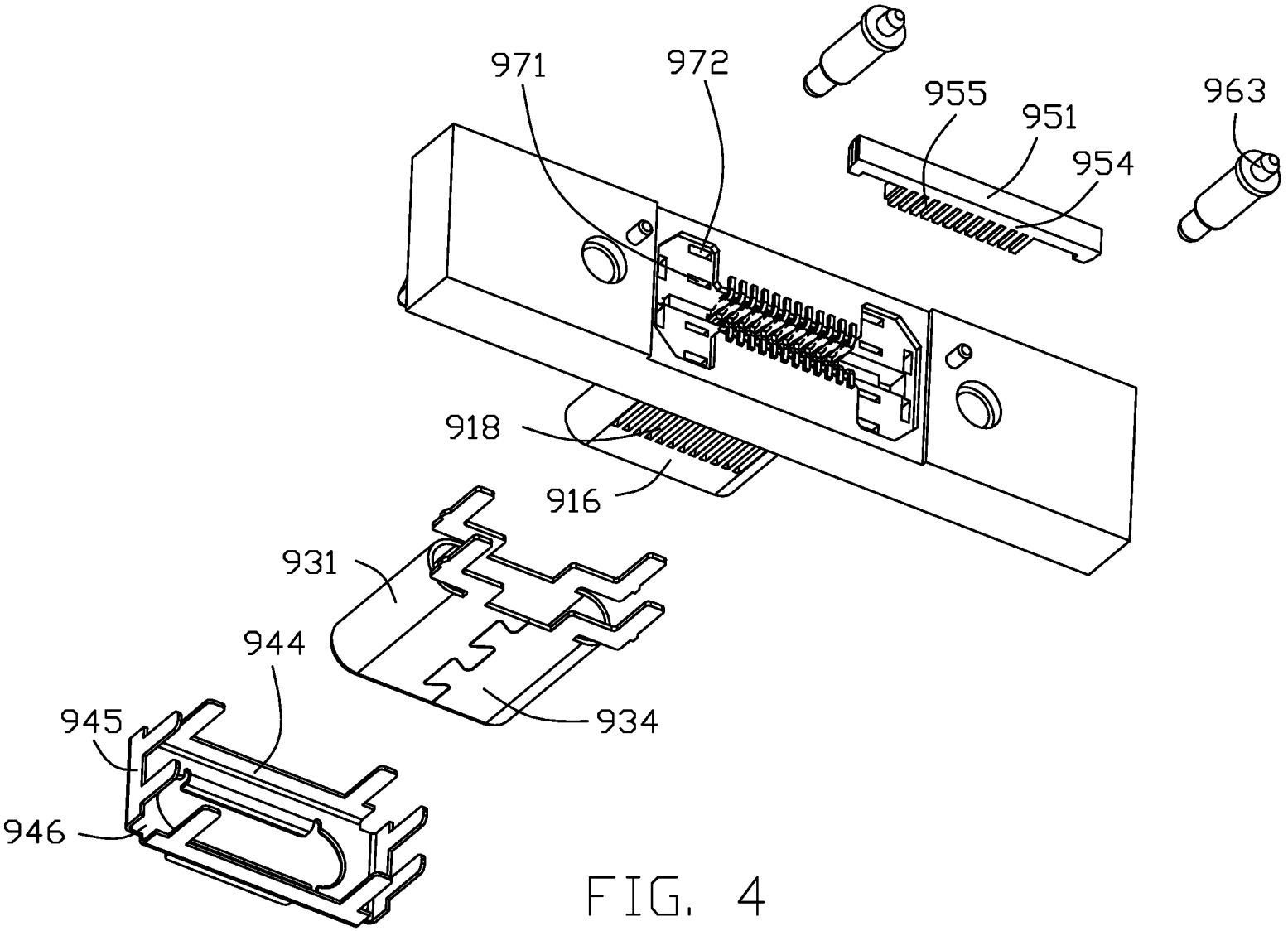
FIG. 4 is a rear exploded view of FIG. 3.
Figure 5:
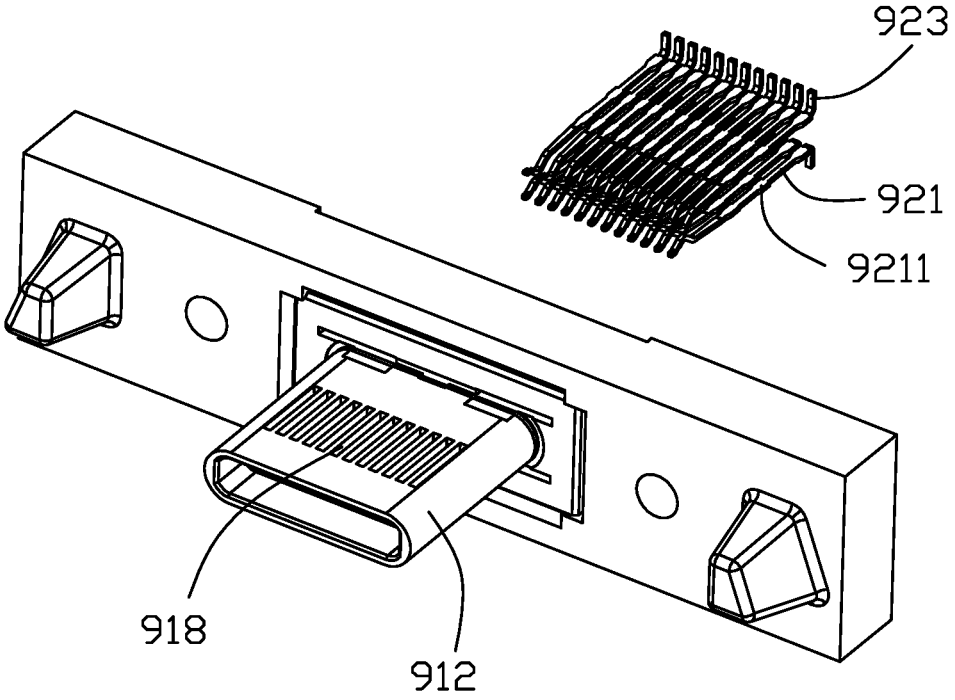
FIG. 5 is a front perspective view of an insulative housing and a plurality of terminals of FIG. 1.

Referring to FIGS. 1 and 2, the electrical connector 100 includes an insulative housing 91, a plurality of terminals 92 retained to the insulative housing 91, a metallic shell 93, a metallic (cover) member 94 retained to the insulative housing 911, a sealing member 95 retained to a rear side of the insulative housing 91, and a pair of pogo pins 96 retained to the insulative housing 91.

Referring to FIGS. 3-6, the insulative housing 91 includes a base 911 extending along a longitudinal direction, a mating portion 912 extending forwardly from the base 911, and two protruding/securing portions 913 extending forwardly from two opposite sides of the base 911 along a front-to-back direction for securing/mounting. The base 911 includes two mounting holes 914 to retain the pair of pogo pins 96, respectively. Each of the pogo pins 96 includes a holding portion 961 retained in the mounting hole 914, a contacting portion 962 extending forwardly out of the mounting hole 914, and a tail portion 963 extending backwardly out of the base 911. The contacting portion 962 is flexible in a certain range along a front-to-back direction perpendicular to the longitudinal direction when the electrical connector 100 is mating with the corresponding connector. The mating portion 912 includes an upper wall 915, a lower wall 916 opposite to the upper wall 915, two side walls 917 connecting between the upper and lower walls 915, 916, and a mating space 901 defined therebetween. The upper wall 915 and the lower wall 916 include a plurality of terminal slots 918 further extending toward the base 911 for receiving the terminals 92, respectively. Each of the protruding portions 913 is an irregular structure with a small front end and a large back end so that the electrical connector 100 would not be damaged as incorrect insertion of the corresponding connector. All of the mating portion 912, the pogo pins 96, and the protruding portions 913 are located at the same side of the base 911 along the front-to-back direction. The pogo pin 96 is located between the protruding portion 913 and the mating portion 912 along the longitudinal direction. The pogo pin 96 and the mating portion 912 are spaced from each other.

Each of the terminals 92 includes a retaining section 921 retained to the base 911, a connecting section 922 extending forwardly from the retaining section 921 into the mating space 901, and a soldering section 923 bended downwardly or upwardly from the retaining section 921 along a vertical direction perpendicular both of the longitudinal direction and the front-to-back direction. The retaining section 921 includes a plurality of barbs 924 to interfere with the insulative housing 91.

The metallic shell 93 includes a main portion 931 surrounding around the mating portion 912 and a plurality of mounting pins 932 extending backwardly from the main portion 931 to be retained to the base 911. The main portion 931 includes two main flat portions 934 respectively covering on the upper and lower walls 915, 916, and two curved portions 933 connecting between the two flat portions 934. Each of the mounting pins 932 includes a plurality of barbs 935 to interfere with the base 911.

The metallic (cover) member 94 includes a planar body portion 941 retained to the base 911, two extending portions 942 extending forwardly from two opposite sides of the body portions 941, and a plurality of mounting/securing pins 943 extending backwardly from the body portion 941. The body portion 941 covering on a front surface of the base 911 defines an opening 947. The metallic shell goes through the opening 947. The two extending portions 942 located at two opposite sides of the opening 947 in the vertical direction are elastic cantilevers. The two extending portions 942 contact and are optionally further soldered to the two flat portions 934, respectively. The metallic (cover) member 94 includes two opposite long walls 944 bended backwardly from the body portion 941, two short walls 945 located between the two long walls 944 in the vertical direction, and four notches 946 located between the two long walls 944 and short walls 945, respectively. The mounting pins 943 extend backwardly from the long walls 944 and short walls 945, respectively.

The sealing member 95 is retained in the base 911 and located between two rows of the terminals 92. The sealing member 95 includes a covering portion 951 and a projecting portion 952 extending forwardly from the covering potion 951. The covering portion 951 includes two hooks 953 located at two opposite sides of the covering portion 951 to retain to the base 911. The projecting portion 952 includes a plurality of interval bumps 954 protruding from two opposite surfaces thereof for sustaining the retaining sections 921. A plurality of grooves 955 are defined between the bumps 954, respectively.

Figure 6:
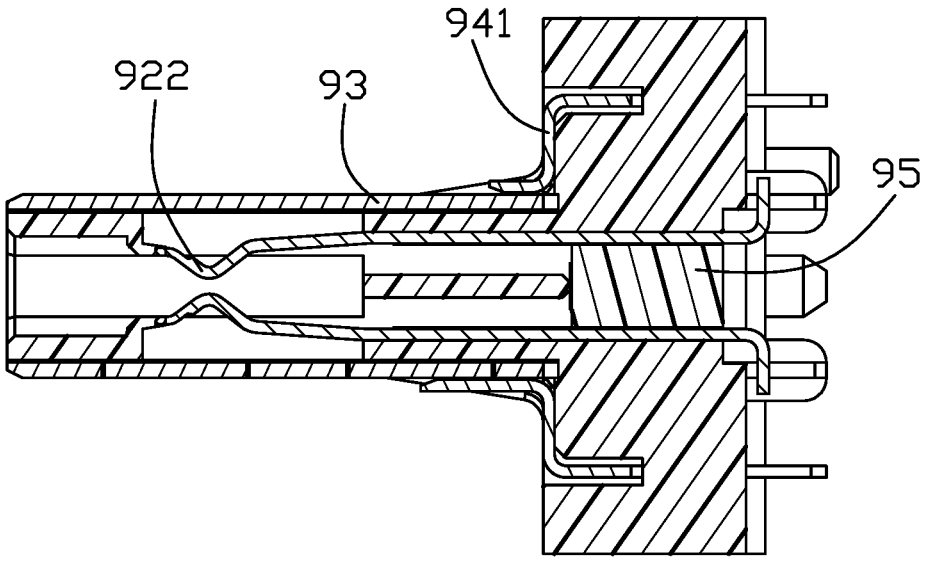
FIG. 6 is a cross-sectional view of the electrical connector in FIG. 1 taken along line 6-6 thereof.
Figure 7:
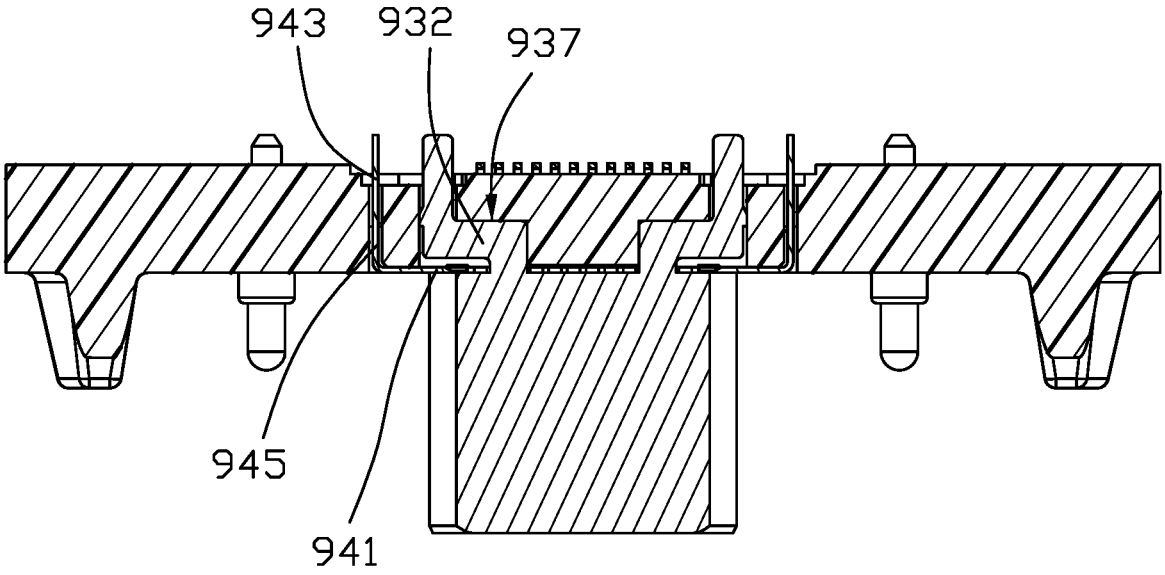
FIG. 7 is another cross-sectional view of the electrical connector in FIG. 1 taken along line 7-7 thereof.

Compared with the prior arts, the electrical connector 100 of the present invention is mounted to the magnetic mechanism. When the corresponding/complementary connector is inserted into the mating space 901, the magnetic mechanism and the corresponding mating connector magnetically attract to each other. Then, the magnetic mechanism may replace the latch of the standard Type C plug connector for retention. The feature of the invention is to provide the enlarged base 911 unitarily formed with the mating portion 912 wherein the main portion 931 of the metallic shell 93 encloses the mating portion 912 with the corresponding mounting pins 932 retainably, protectively and snugly extending through the corresponding inner holes 971 in the base 911. The mounting pin 932 forms an L-shaped structure having a shoulder 937 rearwardly abutting against the base 911 of the housing 91 for preventing further rearward movement of the metallic shell 93 with regard to the base 911 of the housing 91. The mounting/securing pins 943 of the metallic (cover) member 94 also retainably, protectively and snugly extend through the corresponding outer holes 972 in the base 911 outside of the corresponding mounting pins 932. Notably, the body portion 941 of the metallic member 94 is rearwardly seated upon the base 911 of the housing 91 for preventing further rearward movement of the metallic member 94 with regard to the housing 91, and also rearwardly confronts the mounting pins 932 in the base 911 of the housing 91 for restricting forward movement of the metallic shell 93 to assure no withdrawal of the metallic shell 93 from the housing 91 while the main portion 931 extends through the opening 947 of the metallic member 94 for mating. As shown in FIG. 6, the long wall 944 and the short wall 945 are received within the corresponding slots (not labeled) in the base 911 and form rear edges optionally rearwardly abutting against the base 911 of the housing 91 for preventing further rearward movement of the metallic member 94 with regard to the base 911 of the housing 91; wherein the securing pins 943 extend from the corresponding long walls 944 and short walls 945, respectively. The sealing member 95 not only assures waterproofing but also regulates the soldering sections 923 of the terminals 92 for the true positions thereof. In brief, the unitary structure of the base 911 and the mating portion 912 cooperating with the interengaged metallic shell 93 and metallic member 94, may provide superior strength of the whole connector assembly during mating, wherein the base 911 includes a pair of securing portions 913 at two opposite ends.

However, the disclosure is illustrative only, changes may be made in detail, especially in matter of shape, size, and arrangement of sections within the principles of the invention.

What is claimed is:

1. An electrical connector for mounting to a magnetic mechanism, comprising:

an insulative housing having a longitudinal base extending along a longitudinal direction and a mating portion extending forwardly from the base along a front-to-back direction, the mating portion comprising an upper wall, a lower wall opposite to the upper wall along a vertical direction perpendicular to both of the longitudinal direction and the front-to-back direction, two side walls connecting between the upper and lower walls, and a mating space defined therebetween, the upper and lower walls defining a plurality of terminal slots, respectively;

a plurality of terminals retained to the insulative housing and divided into two rows arranged along the longitudinal direction, the two rows of terminals respectively retained to the terminal slots of the upper and lower walls, and each of the terminals comprising a connecting section extending forwardly into the mating space; and a pair of pogo pins mounted at two opposite sides of the mating portion, the pogo pins and the mating portion spaced apart from each other;

further comprising a sealing member with a plurality of interval bumps located between the two rows terminals and a plurality of grooves defined between the interval bumps, respectively, to completely occupy a space between the terminal slots of the upper wall and those of the lower wall for achieving sealing in the front-to-back direction.

2. The electrical connector as claimed in claim 1, wherein each of the pogo pins comprises a holding portion retained to the base and a contacting portion protruding forwardly out of the holding portion, and the contacting portion is flexible in a certain range along the front-to-back direction.

3. The electrical connector as claimed in claim 1, wherein the base comprises a pair of protruding portions protruding forwardly from two opposite sides thereof, and each of the protruding portions is an irregular structure with a small front end and a large back end.

4. The electrical connector as claimed in claim 3, wherein the mating portion, the pogo pins and the protruding portions are located at the same side of the base, and the pogo pins are located between the protruding portions and the mating portion along the longitudinal direction, respectively.

5. The electrical connector as claimed in claim 1, wherein each of the terminals comprises a retaining section retained to the base, a connecting section extending forwardly from the retaining section, and a soldering section extending backwardly from the retaining section out of the base, and the retaining section comprises a plurality of barbs protruding outwardly to interfere with the base.

6. The electrical connector as claimed in claim 5, further comprising a metallic shell with a main portion covering on the mating portion and a metallic member with two opposite elastic cantilevers extending forwardly therefrom, and the elastic cantilevers cover on two opposite surfaces of the main portion, respectively.

7. The electrical connector as claimed in claim 6, wherein the elastic cantilevers are soldered to the main portion so that the metallic shell and the metallic member are retained together.

8. An electrical connector comprising:

an insulative housing including:

a base extending along a longitudinal direction;

a mating portion unitarily extending forwardly from the base in a front-to-back direction perpendicular to said longitudinal direction;

a plurality of terminal slots formed in the housing;

a plurality of terminals disposed in the corresponding terminal slots, respectively;

a metallic shell attached to the housing to cover the mating portion; and a metallic cover member attached to the housing and forming a planar body portion rearwardly abutting against the base in the front-to-back direction; wherein said body portion forms an opening through which the mating portion forwardly extends in said front-to-back direction; wherein the base forms a plurality of inner holes and a plurality of outer holes outside of said inner holes, and the shell forms a plurality of mounting pins extending protectively and snugly through the corresponding inner holes while the cover member forms a plurality of securing pins extending protectively and snugly through the corresponding outer holes.

9. The electrical connector as claimed in claim 8, wherein said planar body portion rearwardly confronts a portion of the metallic shell for restricting forward movement of the metallic shell.

10. The electrical connector as claimed in claim 8, wherein a pair of securing potions are located at two opposite ends of the base in the longitudinal direction.

11. The electrical connector as claimed in claim 10, further including a pair of pogo contacts disposed in the base and respectively located between the securing portions and the mating portion in the longitudinal direction.

12. The electrical connector as claimed in claim 8, wherein said metallic shell forming at least a shoulder rearwardly abutting against the base for preventing further rearward movement of the metallic shell with regard to the housing.

13. The electrical connector as claimed in claim 8, wherein each of the inner holes only receives independently the corresponding one of said mounting pins therein for retention.

14. The electrical connector as claimed in claim 13, wherein said plurality of securing pins are located outside of and aligned with the mounting pin in a vertical direction perpendicular to both said front-to-back direction and said longitudinal direction.

15. The electrical connector as claimed in claim 8, further including a sealing member configured to be forwardly assembled to the base in the front-to-back direction to cover the corresponding terminal slots.

16. An electrical connector comprising:

an insulative housing including:

a base extending along a longitudinal direction;

a mating portion unitarily extending forwardly from the base in a front-to-back direction perpendicular to said longitudinal direction;

a plurality of terminal slots formed in the housing;

a plurality of terminals disposed in the corresponding terminal slots, respectively;

a metallic shell attached to the housing to cover the mating portion; and a one-piece metallic cover member attached to the housing and having a planar body portion located in front of the base and configured to be rearwardly assembled upon the base in the front-to-back direction; wherein said body portion unitarily forms an opening, through which the mating portion forwardly extends in said front-to-back direction, and a pair of extending portions opposite to each other in a vertical direction perpendicular to both the longitudinal direction and the front-to-back direction, each of said extending portions extending forwardly in the front-to-back direction around the opening and contacting the mating portion in the vertical direction.

17. The electrical connector as claimed in claim 16, wherein said extending portion is fixed to the mating portion.

18. The electrical connector as claimed in claim 16, wherein the metallic shell includes a plurality of mounting pins extending through corresponding through holes in the base, and the metallic cover member includes a plurality of securing pins extending through corresponding through holes in the base, said securing pins being located outside of the mounting pins in said vertical direction perpendicular to both said front-to-back direction and said longitudinal direction.

19. The electrical connector as claimed in claim 18, wherein the cover includes a pair of long walls and a pair of short walls both of which are perpendicular to the planar body and received within corresponding slots in the base, and the securing pins extend from the corresponding long walls and short walls, respectively.

20. The electrical connector as claimed in claim 13, wherein the mounting pins are coplanar with corresponding main flat portions of the shell in the front-to-back direction.

* * * * *